US005749352A

United States Patent [19]

McFarlin

[11] Patent Number: 5,749,352

[45] Date of Patent: May 12, 1998

[54] ARCHERY CROSS HAIR SIGHT PROTECTOR

[76] Inventor: Lawrence McFarlin, Rt. 2 Box 538, Glencoe, Okla. 74032

[21] Appl. No.: 762,270

[22] Filed: Dec. 9, 1996

[51] Int. Cl.[6] ..... F41B 5/00

[52] U.S. Cl. ..... 124/87; 33/265

[58] Field of Search ..... 124/86, 87, 1; 33/265

[56] References Cited

U.S. PATENT DOCUMENTS 3,279,071 10/1966 Bilyeu et al. ..... 33/265

4,984,372 1/1991 Blizzard ..... 33/265

5,157,839 10/1992 Beutler ..... 33/265

5,421,315 6/1995 Miller ..... 124/87

5,575,072 11/1996 Eldrige ..... 124/87 X

*Primary Examiner*—Terry Lee Melius

*Assistant Examiner*—Thomas A. Beach

[57] ABSTRACT

A new Archery Cross Hair Sight Protector for protecting the cross hair sight of a bow from contacting objects such as brush, weeds, and twigs which damage the cross hair sight. The inventive device includes a protective cover substantially rectangular shaped with an opening formed to snugly fit over a sight of a bow, and a securing means to retain the protective cover close to the bow when removed from the sight.

11 Claims, 3 Drawing Sheets

Fig. 5
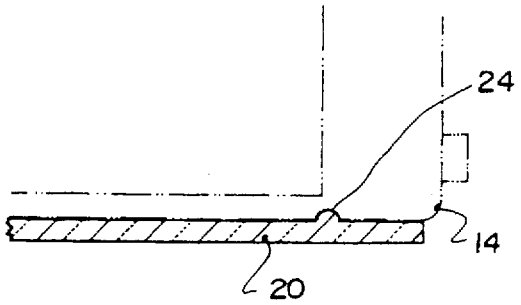
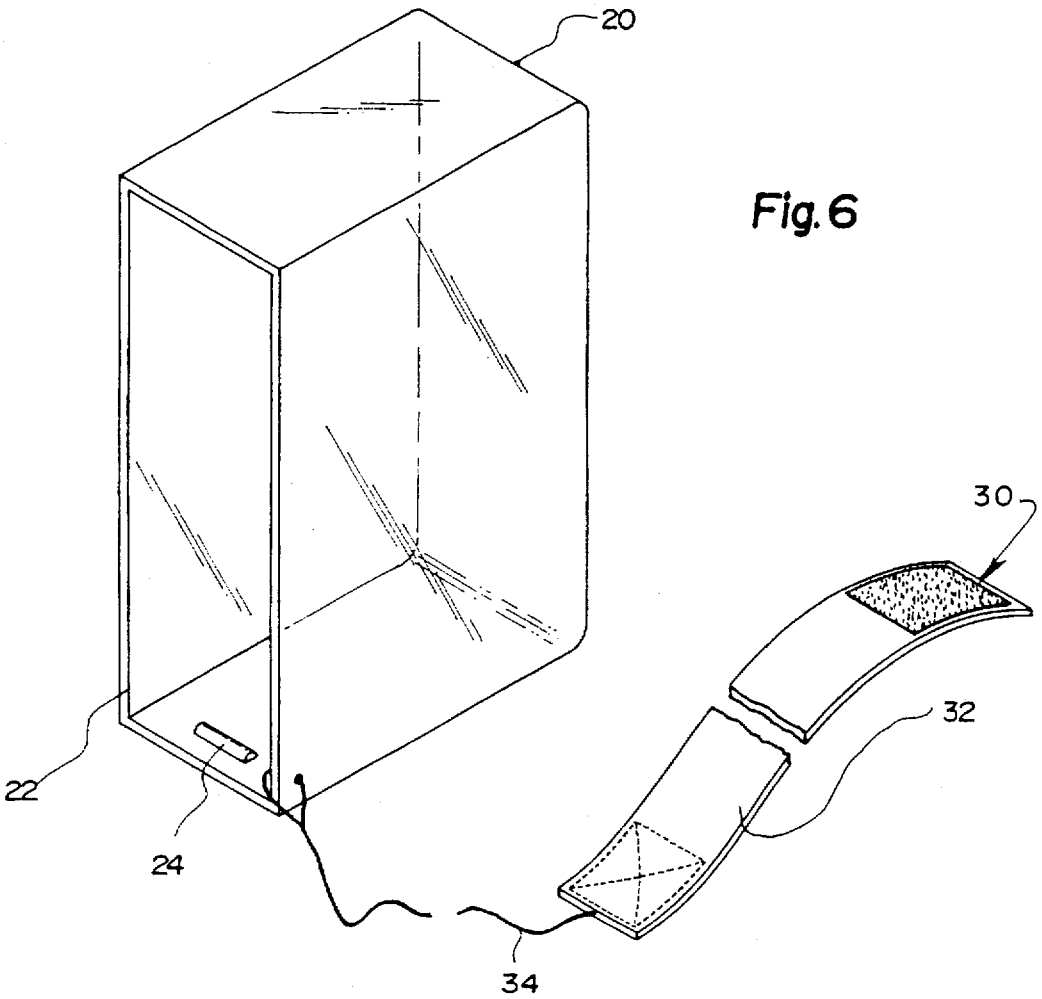
Fig. 6

ARCHERY CROSS HAIR SIGHT PROTECTOR

BACKGROUND OF THE INVENTION

1.Field of the Invention

The present invention relates to Bow Sight Devices and more particularly pertains to a new Archery Cross Hair Sight Protector for protecting the cross hair sight of a bow from contacting objects such as brush, weeds, and twigs which damage the cross hair sight.

2.Description of the Prior Art

The use of Bow Sight Devices is known in the prior art. More specifically, Bow Sight Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Bow Sight Devices include U.S. Pat. No. 4,785,791; U.S. Pat. No. 4,394,797; U.S. Design Pat. No. 318,707; U.S. Pat. No. 4,332,231; U.S. Pat. No. 4,984,372 and U.S. Pat. No. 4,833,786.

While these devices fulfill their respective, particular objectives and requirements, the aforementioned patents do not disclose a new Archery Cross Hair Sight Protector. The inventive device includes a protective cover substantially rectangular shaped with an opening formed to snugly fit over a sight of a bow, and a securing means to retain the protective cover close to the bow when removed from the sight.

In these respects, the Archery Cross Hair Sight Protector according to the present invention substantially departs from the conventional concepts and designs of the prior art, and in so doing provides an apparatus primarily developed for the purpose of protecting the cross hair sight of a bow from contacting objects such as brush, weeds, and twigs which damage the cross hair sight.

SUMMARY OF THE INVENTION

In view of the foregoing disadvantages inherent in the known types of Bow Sight Devices now present in the prior art, the present invention provides a new Archery Cross Hair Sight Protector construction wherein the same can be utilized for protecting the cross hair sight of a bow from contacting objects such as brush, weeds, and twigs which damage the cross hair sight.

The general purpose of the present invention, which will be described subsequently in greater detail, is to provide a new Archery Cross Hair Sight Protector apparatus and method which has many of the advantages of the Bow Sight Devices mentioned heretofore and many novel features that result in a new Archery Cross Hair Sight Protector which is not anticipated, rendered obvious, suggested, or even implied by any of the prior art Bow Sight Devices, either alone or in any combination thereof.

To attain this, the present invention generally comprises a protective cover substantially rectangular shaped with an opening formed to snugly fit over a sight of a bow, and a securing means to retain the protective cover close to the bow when removed from the sight.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Archery Cross Hair Sight Protector apparatus and method which has many of the advantages of the Bow Sight Devices mentioned heretofore and many novel features that result in a new Archery Cross Hair Sight Protector which is not anticipated, rendered obvious, suggested, or even implied by any of the prior art Bow Sight Devices, either alone or in any combination thereof.

It is another object of the present invention to provide a new Archery Cross Hair Sight Protector which may be easily and efficiently manufactured and marketed.

It is a further object of the present invention to provide a new Archery Cross Hair Sight Protector which is of a durable and reliable construction.

An even further object of the present invention is to provide a new Archery Cross Hair Sight Protector which is susceptible of a low cost of manufacture with regard to both materials and labor, and which accordingly is then susceptible of low prices of sale to the consuming public, thereby making such Archery Cross Hair Sight Protector economically available to the buying public.

Still yet another object of the present invention is to provide a new Archery Cross Hair Sight Protector which provides in the apparatuses and methods of the prior art some of the advantages thereof, while simultaneously overcoming some of the disadvantages normally associated therewith.

Still another object of the present invention is to provide a new Archery Cross Hair Sight Protector for protecting the cross hair sight of a bow from contacting objects such as brush, weeds, and twigs which damage the cross hair sight.

Yet another object of the present invention is to provide a new Archery Cross Hair Sight Protector which includes a protective cover substantially rectangular shaped with an opening formed to snugly fit over a sight of a bow, and a securing means to retain the protective cover close to the bow when removed from the sight.

Still yet another object of the present invention is to provide a new Archery Cross Hair Sight Protector that extends the useful life of a sight.

Even still another object of the present invention is to provide a new Archery Cross Hair Sight Protector that prevents the cross sight from being hit out of alignment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross sectional view taken along line 5—5 of FIG. 4.

FIG. 6 is an upper perspective view of the present invention with a securing means attached.

DESCRIPTION OF THE PREFERRED EMBODIMENT

Figure 1:
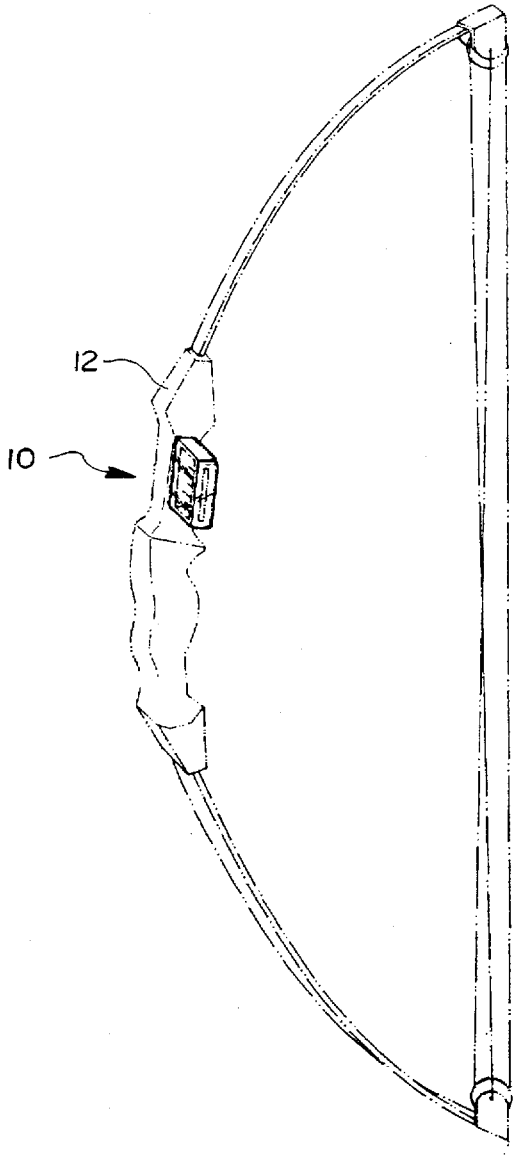
FIG. 1 is an upper side perspective view of a new Archery Cross Hair Sight Protector according to the present invention.
Figure 2:
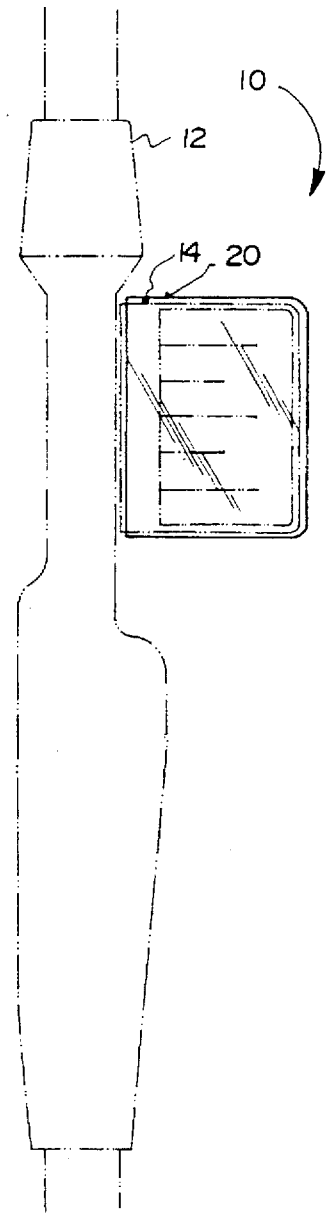
FIG. 2 is a front view of the present invention secured to a sight.
Figure 3:
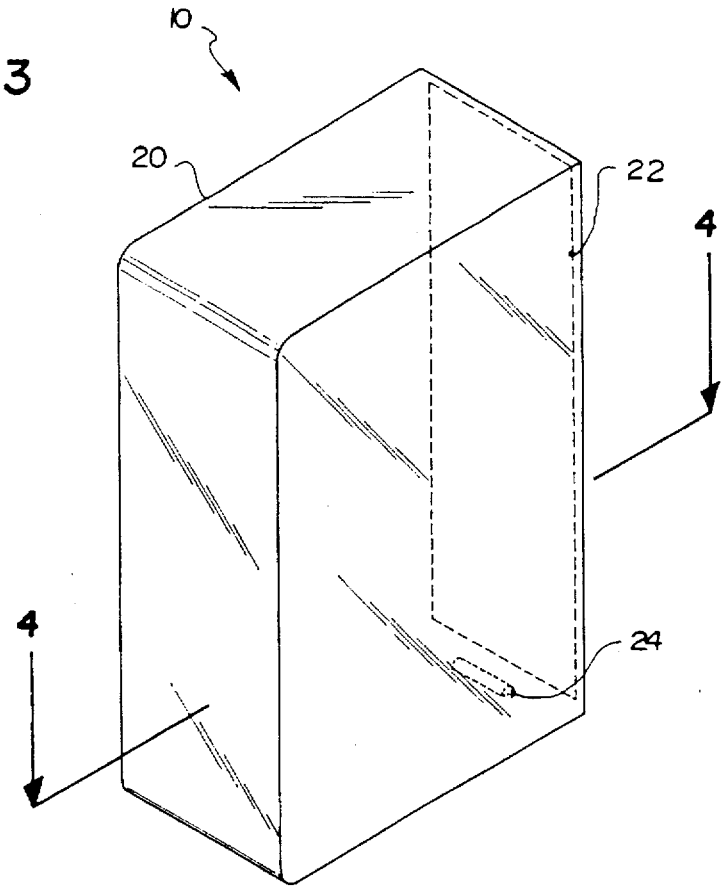
FIG. 3 is a magnified upper perspective view of the present invention.
Figure 4:
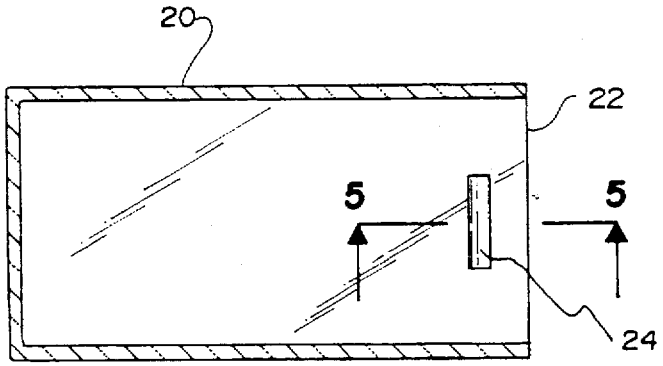
FIG. 4 is a cross sectional view taken along line 4—4 of FIG. 3.

With reference now to the drawings, and in particular to FIGS. 1 through 6 thereof, a new Archery Cross Hair Sight Protector embodying the principles and concepts of the present invention and generally designated by the reference numeral 10 will be described.

More specifically, it will be noted that the Archery Cross Hair Sight Protector 10 comprises a protective cover 20 with an opening 22 formed to snugly encase a sight 14 of a bow 12.

As best illustrated in FIGS. 3 through 6, it can be shown that the protective cover 20 has a retaining detent 24 secured to the interior portion which engages the edge of the sight 14 to retain the protective cover 20 onto the sight 14. The protective cover 20 is preferably made from a resilient plastic. The protective cover 20 is also preferably transparent allowing the user to utilize the protective cover 20 during operation of said bow 12. Also, the protective cover 20 has a non-glare coating which prevents glare from bright light. A securing means 30 is attached to the protective cover 20 and removably attached to the bow 12 at the opposite end. The securing means has a cord 34 secured at one end to the protective cover 20, and a hook and loop strap 32 secured to the cord 34 opposite of the protective cover 20, where the hook and loop strap 32 removably engages the bow 12 during utilization.

Alternatively, the protective cover 20 can be constructed from semi-transparent plastic, opaque plastic, or camouflage plastic.

In use, the user manually manipulates the protective cover 20 over the sight 14 by positioning the opening 22 juxtaposed to the sight 14. The protective cover 20 is slid over the sight 14 until the retaining detent 24 engages the sight 14 thereby preventing accidental removal of said protective cover 20 during operation. The user may retain the protective cover 20 on the sight 14 during shooting or the user may remove the protective cover 20 depending upon the user's preferences or weather conditions.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An archery cross hair sight protector comprising:

a protective cover with an opening formed to encase a cross hair sight of an archery bow; a securing means attached to said protective cover and removably attached to said bow, said securing means including a cord secured at one end to said protective cover and a securing strap mounted on said cord at an end thereof opposite of said protective cover, said securing strap having hook and loop fastenings means thereon for removably securing said securing strap to a bow such that said securing means secures said protective cover to said bow when said protective cover is removed from engagement with said cross hair sight.

2. The archery cross hair sight protector of claim 1 wherein said protective cover has an interior surface and includes a retaining detent secured to the interior surface of the protective cover for engaging an edge of a cross hair sight to retain said protective cover on said cross hair sight.

3. The archery cross hair sight protector of claim 2 wherein said protective cover is comprised from a resilient plastic.

4. The archery cross hair sight protector of claim 3 wherein said protective cover is transparent.

5. The archery cross hair sight protector of claim 1 wherein said protective cover includes a non-glare coating which prevents glare from bright ambient light.

6. The archery cross hair sight protector of claim 3 wherein said protective cover is semi-transparent.

7. The archery cross hair sight protector of claim 6 wherein said protective cover includes a non-glare coating which prevents glare from bright ambient light.

8. The archery cross hair sight protector of claim 3 wherein said protective cover is opaque.

9. The archery cross hair sight protector of claim 3 wherein said protective cover is colored to form a camouflage effect which blends in with camouflaged bows.

10. An archery cross hair sight protector comprising:

a protective cover with an opening formed to snugly encase a sight of a bow: wherein said protective cover has an interior surface and includes a retaining detent secured to the interior surface of the protective cover for engaging an edge of a cross hair sight to retain said protective cover on said cross hair sight; said protective cover being comprised from a resilient plastic; said protective cover being colored to form a camouflage effect which blends in with camouflaged bows: and a securing means for attaching said protective cover to a said archery bow;

wherein said securing means includes a cord secured at one end to said protective cover, and a hook and loop strap secured to said cord opposite of said protective cover, where said hook and loop strap removably engages said bow during utilization.

11. An archery cross hair sight protector comprising:

a protective cover with an opening formed to snugly encase a sight of a bow, said protective cover having an interior surface and including a retaining detent secured to the interior surface of the protective cover for engaging an edge of a cross hair sight to retain said protective cover on said cross hair sight, said protective cover being comprised from a resilient plastic, said protective cover being transparent, said protective cover including a non-glare coating which prevents glare from bright ambient light; and a securing means for attaching said protective cover to a said archery bow; said securing means including a cord secured at one end to said protective cover, and a hook and loop strap secured to said cord opposite of said protective cover, where said hook and loop strap removably engages said bow during utilization.

* * * * *